US005379563A

United States Patent [19]

Tinsley

[11] Patent Number: 5,379,563

[45] Date of Patent: Jan. 10, 1995

[54] ANCHORING ASSEMBLY

[75] Inventor: C. Roscoe Tinsley, Longview, Tex.

[73] Assignee: Eastman Chemical Company, Kingsport, Tenn.

[21] Appl. No.: 119,633

[22] Filed: Sep. 13, 1993

[51] Int. Cl.[6] ..... E02D 27/00

[52] U.S. Cl. ..... 52/295; 52/298; 248/679

[58] Field of Search ..... 52/295, 296, 298, 169.5; 248/679, 680

[56] References Cited

U.S. PATENT DOCUMENTS 1,668,486 5/1928 Betts ..... 52/298

5,102,260 4/1992 Horvath et al. ..... 52/169.5 X

FOREIGN PATENT DOCUMENTS 625093 9/1978 U.S.S.R. ..... 248/679

*Primary Examiner*—Carl D. Friedman

*Assistant Examiner*—Creighton Smith

*Attorney, Agent, or Firm*—John F. Stevens; Harry J. Gwinnell

[57] ABSTRACT

Disclosed is an anchoring assembly for securing an object such as heavy machinery to a foundation wherein the foundation is provided with a plurality of holes for accepting elongated mounting members from the object. The holes have barrier means such as a sleeve covering the surface of the holes. The size of the holes including the barrier means is appreciably greater than the size of the mounting members whereby voids are created between the mounting members and the barrier means. The holes connect with a drain at the end opposite the object, whereby fluid draining around the mounting members is conducted through the voids to the drain without contacting the foundation.

2 Claims, 1 Drawing Sheet

ANCHORING ASSEMBLY

TECHNICAL FIELD

This invention relates to anchoring assemblies which have particular utility in securing heavy equipment or machinery to a concrete foundation.

BACKGROUND OF THE INVENTION

Heavy machinery having moving parts such as reciprocating pistons in engines, compressors and the like tends to vibrate or shift in position on its foundation, as well as leak lubricating oil. The foundations are commonly made of concrete. The vibration of the machinery coupled with oil leakage causes oil to come into contact with the concrete foundation which eventually deteriorates the concrete to the point of requiring replacement. Generally, the machinery is anchored to the foundation by bolts or studs, hereinafter sometimes simply called "bolts".

Conventional anchoring assemblies such as "J" bolts have the disadvantage of oil draining down sleeves of the bolts and contaminating the concrete. The life of the concrete is thereby shortened. Bonding of the concrete to the bolts is destroyed, thus preventing the application of correct torque to the bolt required to hold the machinery firmly. Also, conventional anchoring assemblies result in poor load distribution through the foundation. Furthermore, bolt replacement is very difficult in conventional anchoring assemblies. Thus, there is a need to provide an anchoring assembly which overcomes the disadvantages mentioned above.

DESCRIPTION OF THE INVENTION

Figure 1:
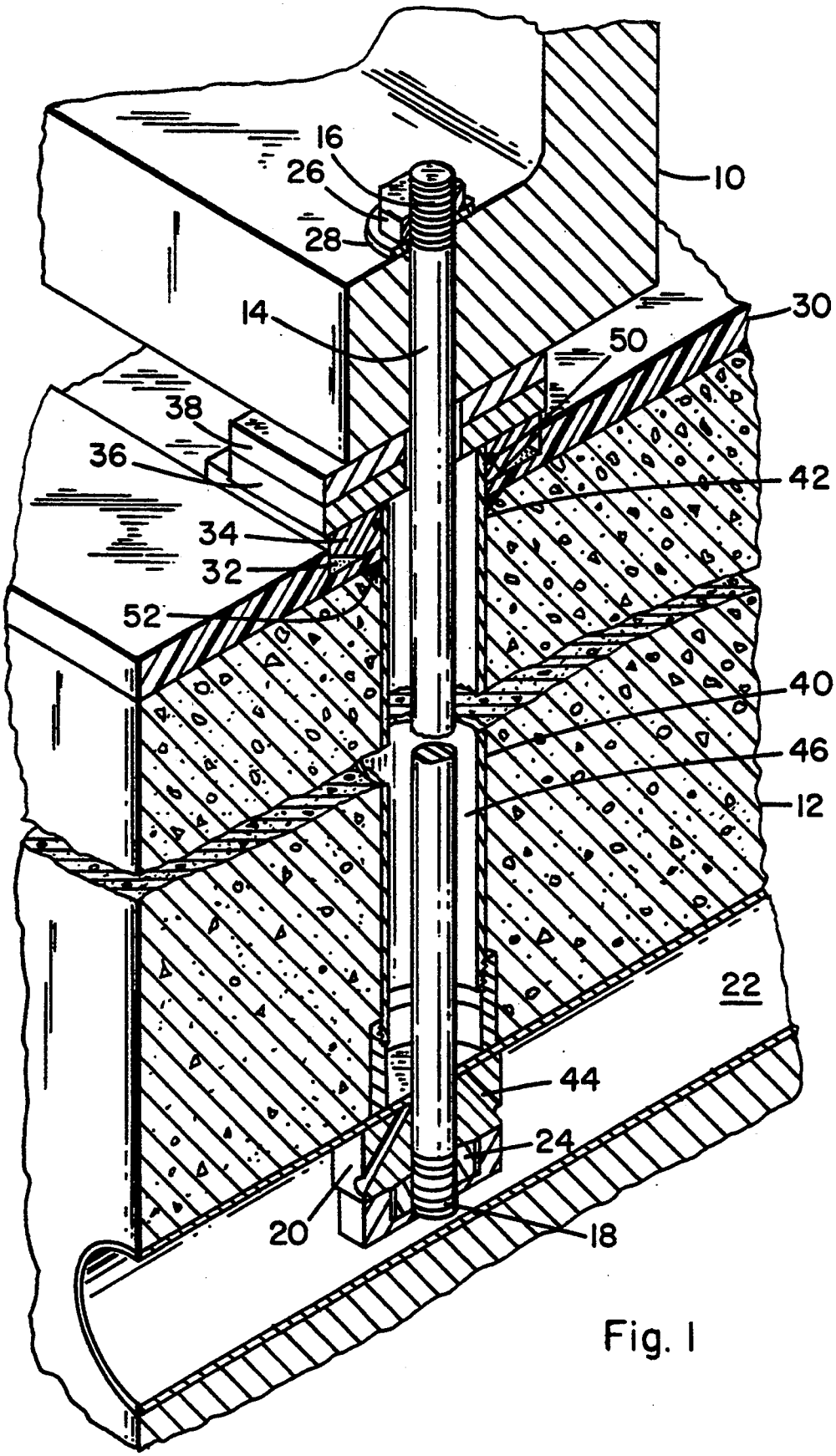
FIGURE 1 is a side elevation view in section showing the anchoring assembly according to this invention.

According to the present invention, there is provided an anchoring assembly for securing an object to a foundation wherein the foundation is provided with a plurality of holes for accepting elongated mounting members extending from the object, the holes having barrier means substantially covering the inner surface thereof, the size of the holes including the barrier means being appreciably greater than the size of the mounting members whereby voids are formed between the mounting members and the barrier means, the holes connecting with a drain at the end opposite the secured object, means for securing the mounting members at the end thereof within the drain, and means at the opposite end of the mounting means for tightening the object against the foundation, whereby fluid draining around the mounting members is conducted through the voids to the drain without contacting the foundation.

The anchoring assembly according to the present invention is very suitable for securing a piece of heavy machinery to a solid foundation such as concrete. By the present invention, problems which have existed in the past due to chemical or fluid leakage around anchoring bolts causing deterioration of concrete surrounding the bolts is greatly reduced or eliminated. Generally, a concrete foundation is provided with a plurality of holes which are in alignment with bolts from the machinery. The bolts are provided with nut or other fasteners at one or both ends so that they may be tightened to secure the machinery. Often, in the case of large machines having reciprocating pistons such as engines or compressors, there is a tremendous amount of movement or vibration caused by the reciprocating parts. Much oil is generally present and leaks down the holes in the concrete around the bolts. Oil has a deteriorating effect on concrete, and in time, the concrete foundation must be replaced. According to the present invention, means are provided for protecting the sidewall of the holes in the concrete from the deteriorating effect of the oil.

The present invention provides numerous advantages over conventional anchoring assemblies. Bolt replacement is much easier, and can be made without damage to the concrete foundation or disturbing the alignment of the equipment. Oil and other liquids can be drained from the equipment through voids around the bolts to a common drain. The anchoring assembly of the present invention provides a better load distribution through the foundation by distributing the force from each anchor bolt through a part called a hinge block in the common drain. A hinge block is a metal part that distributes the load of the bolt evenly to the inner surface of the horizontal drainage tube to the foundation, thus allowing for maximum torque of the fastener. The hinge block also has drainage holes in it to permit accumulated fluid in the void between the bolt and the barrier to drain to the horizontal drainage tube. The hinge block optionally has a spherical or other shaped mating surface to contact with the surface of the nut or other type fastener. Because of the improved load distribution, anchoring bolts can be torqued up to maximum values for better stability of the equipment. The present invention uses a partially spherical nut at the hinge block in the common drain to allow the bolt to have a free fit or be self-aligning. This rounded, or partially spherical nut reduces stress by ensuring proper bolt alignment.

Referred to the drawings, heavy equipment 10 is mounted on concrete foundation 12 by means of bolt 14 which is threaded at end 16 and end 18. Bolt 14 passed through hinge block 20 located in drain line 22, and spherical nut 24 is threaded on to the end of bolt 14. The threaded end 16 of bolt 14 is provided with a nut 26 with matching threads so that the bolt may be tightened. Washer 28 is provided under nut 26 for exerting pressure on equipment 10. Drain line 22 is common to a plurality of anchoring assemblies.

Foundation 12 is provided with oil resistant coating 30. In normal practice, spacers 32, 34, 36 and 38 are provided for proper fit and alignment of the assembly. In a preferred embodiment of this invention, hole 40 in the concrete foundation 12 contains a tubular liner 42 which acts as a barrier and is of a material resistant to deterioration by oil, such as polyvinyl chloride.

Preferably, the hinge block 20 is of a curved shape so as to conform enough with the interior of drain 22 so as not to turn when bolt 14 is threaded therein. Generally, drain 22 is circular metal tubing, so hinge block 20 is provided with a similarly curved upper surface so as to mate therewith as bolt 14 is threaded therein. Hinge block 20 is provided with at least one drain opening 44 which leads from void 46 to common drain 22. Access to the hinge block assembly can be obtained through the common drain 22.

In operation, machinery 10 tends to vibrate enough the cause oil which is constantly leaking from machinery 10 to seep along any available route to the void between bolt 14 and barrier tube 42. The parts would seem to be held sufficiently tight by nut 26 threaded onto bolt 14 to prevent such seepage. However, as the machinery 10 begins to vibrate, oil inevitably finds its way along various paths to the void space 46. For example, a route for oil seepage may be around nut 26 and washer 28.

In the past, this seepage would attack the concrete along the sidewall of hole 40. Seals 50 and 52 are provided to prevent oil from seeping around the outside of barrier tube 42 to the inner surface of hole 40.

The invention has been described in detail with particular reference to preferred embodiments thereof, but it will be understood that variations and modifications can be effected within the spirit and scope of the invention.

I claim:

1. Anchoring assembly for securing an object to a foundation wherein said foundation is provided with a plurality of holes having a surface and a predetermined size for accepting elongated mounting members from said object, said holes having barrier means substantially covering the surface of said holes, the size of said holes including said barrier means being appreciably greater than the size of said mounting members whereby voids are created between said mounting members and said barrier means, said holes connecting with a drain at the end opposite said object, means for securing said mounting members at an end thereof within said drain, and means at the opposite end of said mounting members for tightening said object against said foundation, whereby fluid draining around the mounting members is conducted through said voids to said drain without contacting said foundation.

2. Anchoring assembly for securing an object to a substantially horizontal concrete foundation wherein said foundation is provided with a plurality of generally vertical holes having a lower end for containing bolts or studs extending from said object, said holes having a liner of predetermined size which is resistant to deterioration by chemicals or other fluids, the size of said liner being appreciably larger than said bolts or studs whereby voids are created between said liner and said studs or bolts, said holes connecting with a drain at the lower end thereof, means consisting of hinge blocks and nuts or other fasteners for securing said bolts or studs at an end thereof within said drain, and means at the opposite end of said bolts or studs for tightening said object against said foundation, whereby fluid draining around the bolts or studs is conducted through said voids to said drain without contacting said foundation.

* * * * *